US008342159B2

(12) United States Patent
Detore

(10) Patent No.: US 8,342,159 B2
(45) Date of Patent: Jan. 1, 2013

(54) FUEL LINE IONIZER

(75) Inventor: Charles M. Detore, Avon Park, FL (US)

(73) Assignee: Rexecon International, Inc., Delray Beach, FL (US)

( * ) Notice: Subject to any disclaimer, the term of this patent is extended or adjusted under 35 U.S.C. 154(b) by 194 days.

(21) Appl. No.: 12/850,933

(22) Filed: Aug. 5, 2010

(65) Prior Publication Data

US 2011/0030636 A1 Feb. 10, 2011

Related U.S. Application Data

(60) Provisional application No. 61/231,813, filed on Aug. 6, 2009.

(51) Int. Cl.
*F02M 33/00* (2006.01)

(52) U.S. Cl. ..... 123/538

(58) Field of Classification Search ..... 123/536–538
See application file for complete search history.

(56) References Cited

U.S. PATENT DOCUMENTS

| | | | | |
|---|---|---|---|---|
| 2,033,753 | A | 3/1936 | Bucklen | |
| 2,231,605 | A | 2/1941 | Stephenson et al. | |
| 2,999,485 | A | 9/1961 | Lundy et al. | |
| 4,335,698 | A | 6/1982 | Stephens | 123/537 |
| 4,798,191 | A | 1/1989 | King | 123/538 |
| 4,930,483 | A | 6/1990 | Jones | 123/538 |
| 5,044,347 | A | 9/1991 | Ullrich et al. | 123/538 |
| 5,069,190 | A | 12/1991 | Richards | 123/538 |
| 5,069,191 | A | 12/1991 | Scouten | 123/538 |
| 5,074,273 | A | 12/1991 | Brown | |
| 5,076,246 | A | 12/1991 | Onyszczuk | |
| 5,092,303 | A | 3/1992 | Brown | 123/538 |
| 5,154,153 | A | 10/1992 | MacGregor | 123/538 |
| 5,167,782 | A | 12/1992 | Marlow | 204/168 |
| 5,197,446 | A | 3/1993 | Daywalt et al. | 123/538 |
| 5,305,725 | A | 4/1994 | Marlow | 123/538 |
| 5,307,779 | A | 5/1994 | Wood et al. | 123/538 |
| 5,342,586 | A | 8/1994 | Park | 422/211 |
| 5,393,723 | A | 2/1995 | Finkl | |
| 5,447,625 | A | 9/1995 | Roe | 123/538 |
| 5,524,594 | A | 6/1996 | D'Alessandro | 123/538 |
| 5,871,000 | A | 2/1999 | Ratner | 123/538 |
| 5,881,702 | A | 3/1999 | Arkfeld | 123/538 |
| 6,000,381 | A | 12/1999 | Berlin et al. | 123/538 |
| 6,053,152 | A | 4/2000 | Ratner | 123/538 |

(Continued)

OTHER PUBLICATIONS

PCT Transmittal of International Preliminary Report on Patentability, Feb. 16, 2012.

(Continued)

*Primary Examiner* — M. McMahon
(74) *Attorney, Agent, or Firm* — Robert C. Kain, Jr.

(57) ABSTRACT

The fuel conditioner ionizer, interposed in a fuel line leading to an engine or a furnace, includes a housing, an inlet sealed to the fuel supply line and an outlet sealed to the fuel line leading to the engine or furnace. A plurality of metal wire strands from the plurality of different metals is disposed in the housing. Angular and directional fuel flow is generated by a fluid mixing device mounted in the housing. The mixer is a stationary turbine with a plurality of radially extending blades, circumferentially disposed in the housing. Improvements include an annular ring holding the blades, a central hub in the ring and additional or secondary flow directing blades. A cone or frustoconical segment may be attached or be part of the forward end of the hub to direct the fuel radially outward.

34 Claims, 5 Drawing Sheets

U.S. PATENT DOCUMENTS

| | | | | |
|---|---|---|---|---|
| 6,276,346 | B1 | 8/2001 | Ratner et al. | 123/538 |
| 6,306,185 | B1 | 10/2001 | Berlin et al. | |
| 6,550,460 | B2 | 4/2003 | Ratner et al. | 123/538 |
| 6,675,780 | B1 * | 1/2004 | Wendels et al. | 123/536 |
| 6,748,921 | B1 | 6/2004 | Surges | 123/306 |
| 6,915,789 | B2 | 7/2005 | Ratner et al. | 123/538 |
| 7,104,251 | B2 | 9/2006 | Kim | 123/306 |
| 7,156,081 | B2 | 1/2007 | Ratner | 123/538 |
| 7,543,561 | B2 | 6/2009 | Shibata et al. | 123/306 |
| 2003/0178077 | A1 | 9/2003 | Ramirez-Rivera | 138/44 |
| 2004/0216722 | A1 | 11/2004 | Tamol | 123/536 |
| 2005/0145225 | A1 | 7/2005 | Ratner et al. | 123/538 |
| 2005/0224058 | A1 * | 10/2005 | Kim | 123/538 |
| 2006/0243256 | A1 * | 11/2006 | Hornig | 123/536 |

OTHER PUBLICATIONS

Empower Group, Inc. Clean Combustion Research—Review Report—Fuel Ionization Device to Decrease and Particulate, Fuel Ionization Device to Decrease Diesel Engine NOX Emissions, May 23, 2001, www.fuelcharge.net.

How It Works—DIY Fuel Ionizer at www.instructables.com, print-out Aug. 3, 2010.

* cited by examiner

SECTION A-A

FUEL LINE IONIZER

This is a regular patent application based upon and claiming priority of provisional patent application Ser. No. 61/231,813, filed Aug. 6, 2009, the contents of which is incorporated herein by reference thereto.

The present invention relates to a fuel conditioner ionizer which is an apparatus placed in a fuel line which supplies fuel to an internal combustion engine or a furnace whereby the fuel flowing through the ionizer is altered thereby improving the efficiency of the engine or furnace.

BACKGROUND OF THE INVENTION

Fuel conditioner ionizers are used to ionize fuel flowing to an internal combustion engine or a burner in a furnace. Various ionizers are discussed in U.S. Pat. No. 5,881,702 to Arkfeld and U.S. Pat. No. 5,871,000 to Ratner, among others. The contents of U.S. Pat. No. 5,881,702 to Arkfeld is incorporated herein by reference thereto.

OBJECTS OF THE INVENTION

It is an object of the present invention to provide an apparatus for treating fuel to improve the efficiency of an internal combustion engine or a furnace.

It is another object of the present invention to provide a fuel ionizer which has a housing, a plurality of wire mesh metal strands of different metals, and a fluid mixing device to impart angular and directional fuel flow over the wire mesh strands.

It is an additional object of the present invention to increase ionization of the fuel by swirling the ionized fuel with stationary turbine or flow directing vanes at a downstream location after the different metal wires or strands in the ionizer.

It is an another object of the present invention to increase ionization of the fuel by altering the flow of fuel and dispersing the fuel more efficiently throughout the different metal wires or strands in the ionizer at a position upstream of the wire strands.

SUMMARY OF THE INVENTION

The fuel conditioner ionizer is placed in a fuel line leading to an internal combustion engine or a burner in a furnace. The ionizer apparatus includes a housing with an inlet port and an outlet port and a system thereat to seal the inlet to the fuel supply line and to seal the housing outlet to the fuel line segment leading to the engine or furnace. The ionizer contains, in the housing, a plurality of metal wire strands made of a plurality of different metals. In order to impart angular and directional fuel flow over the ionizing wire strands, a fluid mixer is mounted in the housing. The fluid mixer with fuel directing vanes may be positioned downstream of the wire strands or upstream. The fluid mixing device includes a plurality of radially extending blades which are circumferentially disposed at intervals within the housing. Further improvements include an annular ring holding the blades and a central hub in the center of the annular ring. The hub may be cylindrical and hollow and may further include additional or secondary flow directing blades. A cone or frustoconical segment may be attached or be part of the forward end of the hub to direct the fuel radially outward.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present relates to a fuel line ionizer or fuel conditioner ionizer which is believed to change certain compositional aspects of fuel flowing through the fuel line to an internal combustion engine or a furnace which is supplied with fuel. Similar numerals designate similar items throughout the drawings.

Figure 1:
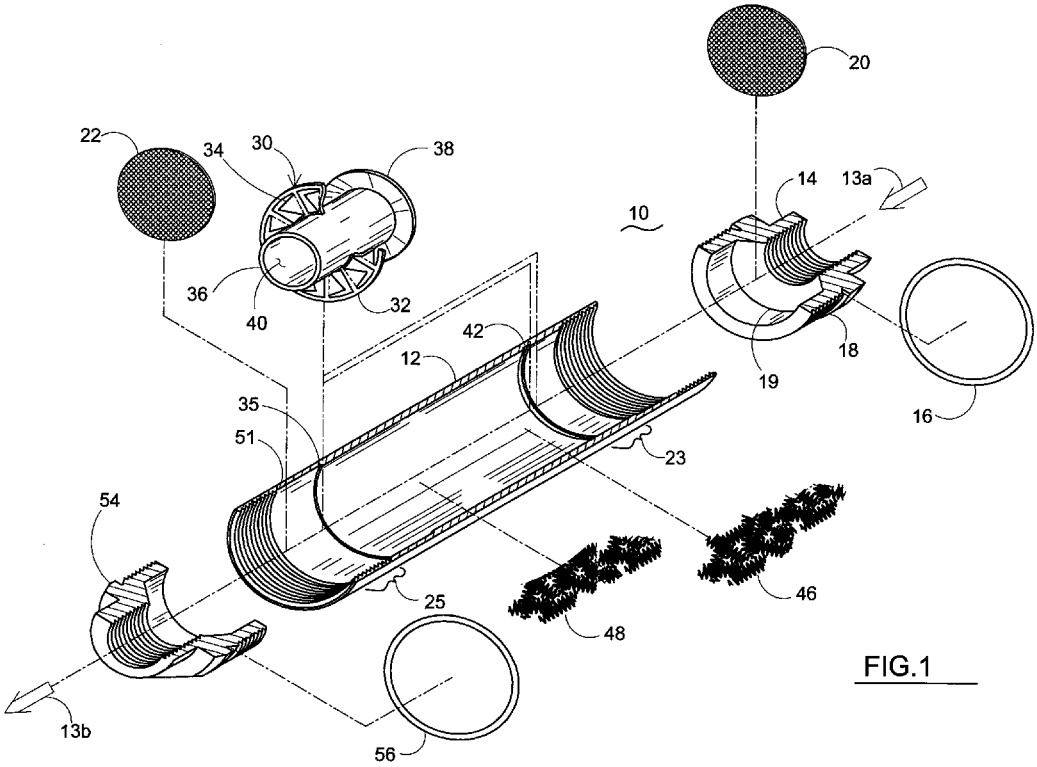
FIG. 1 is an exploded, perspective view of one embodiment of the fuel line ionizer.

FIG. 1 diagrammatically illustrates an exploded, perspective view of fuel line ionizer 10. Fuel line conditioner or ionizer is attached at one end to a fuel line supply segment which carries a supply of fuel in direction 13*a* into inlet port fitting 14 of housing 12. On the output side, fuel exists housing 12 in the direction of arrow 13*b* to a fuel receiving segment of the internal combustion engine or furnace, which segment is in fluid communication with the engine or the burner in the furnace. The outlet port from outlet fitting 54 is sealingly attached to this downstream fuel line segment.

Input fitting 14 is attached via threads or other type of fitting to a housing 12. The housing 12 may be of various metals as discussed later. In addition, housing 12 may include another outer covering or housing to enhance the stability of the fuel conditioner or ionizer.

On the input side, a screen 20 is mounted in inlet shoulder 19. Screen 20 may be held in place by a small shoulder or groove or may held in place by a sleeve running from inlet shoulder 19 to shoulder 42 generally in longitudinal axial region 23. See sleeve 31 in longitudinal axial region 25 in FIG. 2A.

Figure 2A:
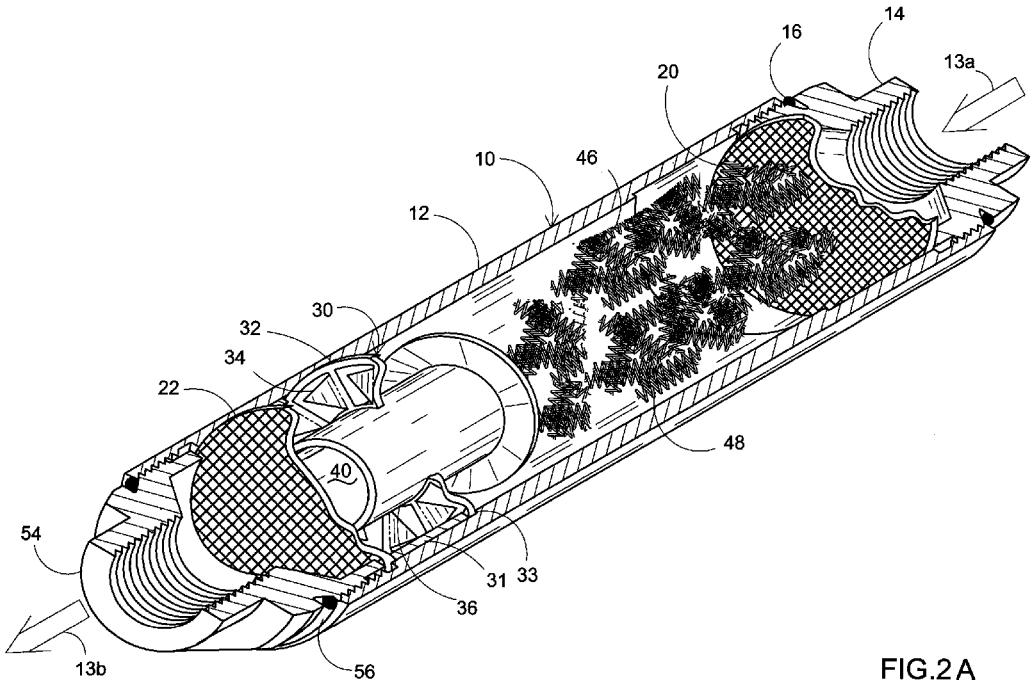
FIG. 2A is a perspective view of the ionizer in an assembled form with a downstream vortex generator or flow directing fixed blade turbine.

The fuel conditioner or ionizer includes a fluid mixing device 30 which is mounted in housing 12. In a preferred embodiment, fluid mixer or vortex generator is mounted downstream of wire mesh stands 46, 48 in groove 35 (FIG. 2A). In another embodiment (FIG. 2B), the fluid director is mounted upstream of the mesh 46, 48 in groove 42. Other mount systems to retain fluid director in the housing may be used.

In its most basic form, the mixing device may be considered as a fixed turbine or a vortex generator since it directs fuel flow in an angular direction throughout the balance of the housing and fuel conditioner. A vortex is created by the blades in the fluid director 30. The mixing device 30, in its most basic form, has a plurality of radially extending blades 34 which are circumferentially disposed at intervals about the interior of the containment housing. Angular flow is imparted to the fuel passing through the blades 34. A simple plate with flow directing vanes 34 may be disposed in groove 42 or 35 of housing 12. A more detailed embodiment of the fluid director includes a plurality of blades, one of which is blade 34, formed in an annular ring 32.

Figure 2B:
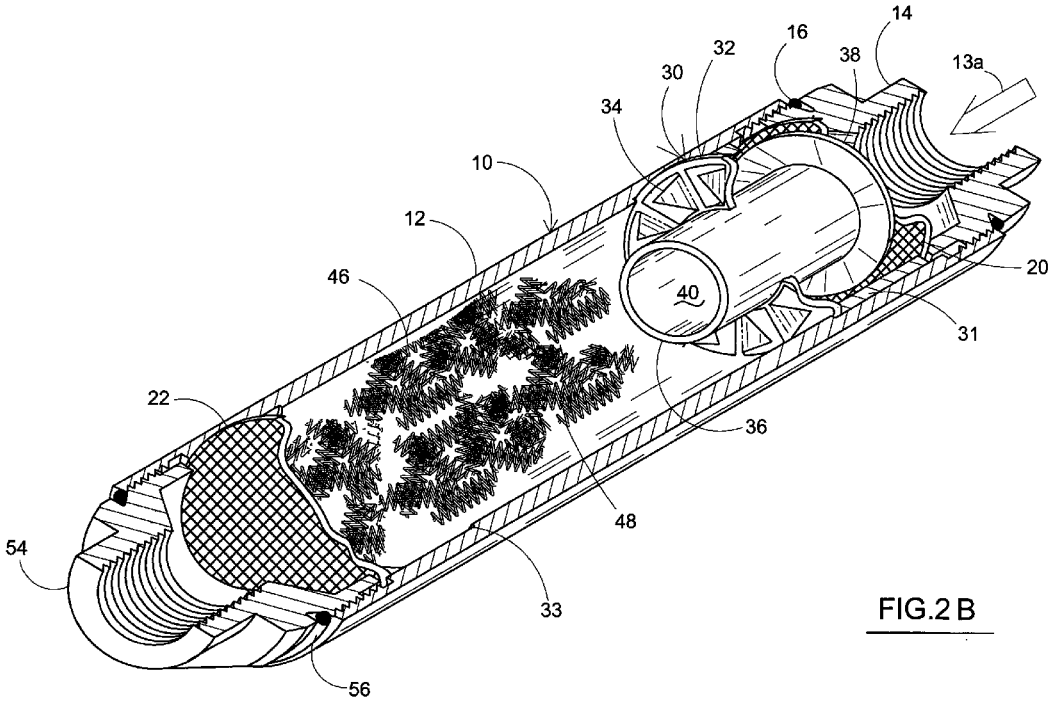
FIG. 2B is a perspective view of the ionizer in an assembled from with an upstream fluid director unit causing a vortex over the wire strands.

In a one embodiment, the radial most edge of annular ring 32 is mounted to groove 42 of housing 12 (FIG. 2B). The ring-groove mount in FIGS. 2A, 2B stabilizes the fluid director in the housing. A further embodiment of the fixed turbine-like fluid director includes a hub structure 36 at the center of annular ring 32. In the preferred embodiment, the hub structure 36 is a hollow cylindrical tube having a central opening 40. Fuel flows through central cavity 40 and fuel flows through and past radially extending blades 34 thereby causing the fuel to have an angular flow pattern. A straight through flow channel may be provided by hub 36 and cavity 40. Additionally in the preferred embodiment, the forward end of central hub 36 has a radially extending flange 38 best shown in FIGS. 3-5. When downstream in groove-mount 35, a vortex is created in the fuel as it leaves the fuel conditioner ionizer. Upstream of the director 30, the fuel is ionizer as explained later.

FIG. 2B shows director 30 in groove mount 42. The vortex or directed fuel flow passes over the wire strands and through the balance of the fuel conditioner.

In one embodiment, the fluid mixing device is upstream of the other ionizing components which are a plurality of metal strands formed of different metals 46, 48. In the upstream director embodiment, the forward most end of hub 36 abuts or is adjacent to screen 20. In this manner, the hub is mounted or stabilized in housing 12 by the forward end of hub 26 abutting screen 20. The downstream end of the fluid director is stabilized by the ring in groove mount. This mount forms a tripod-like mount system with the periphery of ring 32 in groove 42 and the forward small annulus of the forward end of hub 26 abutting screen 20. Forces caused by fuel flow are evenly distributed axially towards the ring-groove mount.

In both upstream and downstream embodiments, the housing retains, in its interior, two sets of metal wire strands, each formed of different metals. These wire strands of different metals are discussed later.

The strands fill up most of the interior of the housing in the preferred embodiment. A the downstream end of the housing 12, is another screen 20 is mounted near the end cap 54. Screen 20 is held in place either in a groove 51 or held in place by a sleeve. End cap 54 is threadably mounted to the output end of housing 12. An O-ring 56 seals end cap 54 to the downstream end of housing 12. Other sealing attachments for end caps 14, 54 on the fuel line segments may be used (screw, snap-on, clamp-on and interference fit systems).

FIGS. 2A and 2B diagrammatically show the fuel line conditioner and ionizer as a single unit. The screens 20, 22 may be held in place by sleeves, one of which is sleeve 31 mounted on the upstream shoulder 33 in the housing 12. In FIG. 2A, sleeve 31 further retains the periphery of annular ring 32 of fluid director 30. The ring edge is in the groove 33 and sleeve 34 further locks the vortex generator-flow director into the housing. The downstream end of sleeve 31 captures screen 22 against the interior or inboard shoulder of the outlet fitting 54. The upstream screen 20 may be securely mounted in the housing 12 in a similar manner. Of course, other mechanical systems may retain the screens in the housing.

FIG. 2A shows different metal meshes 46, 48 upstream of the flow director. Fuel flow is shown by arrows 13*a*, 13*b*. The downstream edge of hub may be adjacent screen 22.

FIG. 2B shows the upstream director version of the system wherein ring 32 is disposed in groove 42.

Figure 3:
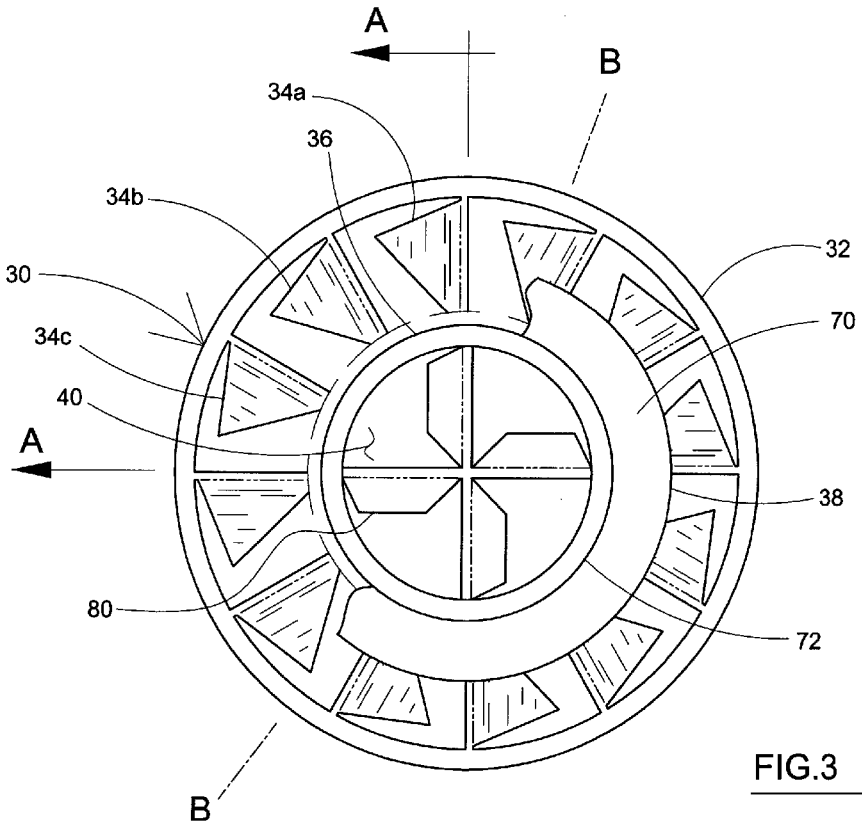
FIGS. 3, 4 and 5 diagrammatically illustrate the fluid mixing device mounted inside the ionizer.

FIG. 3 diagrammatically illustrates a front end view of the fluid mixing device 30. The annular ring 32 has formed thereon a plurality of blades, some of which are identified as blades 34*a*, 34*b* and 34*c*. These blades 34 are circumferentially disposed about the entire circumference of annular ring 32. In a preferred embodiment, the ring is attached or mounted to a hub 36. Also in a preferred embodiment, the hub 36 is a cylinder (see FIG. 4) and interior space 40 of cylinder hub 36 also has a plurality of secondary blades, one of which is blade 80. Radially outer blades 34 impart a first angular directional flow to the fuel flowing through housing 12 and the secondary blades 80 impart a different or a second angular flow to the fuel. In this manner, multi-directional fuel flow is caused by fluid mixing device 30. In order to further enhance the directional flow of fuel, the forward end 72 of fluid device 30 forms a partial conic section or frustoconical member 70. Fuel flowing past frustoconical surface 70 is generally forced radially outward such that it impacts radially extending blade 34 on annular ring 32.

Figure 4:
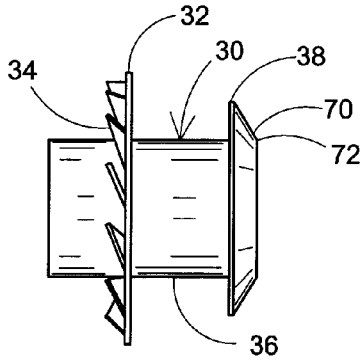
Figure 5:
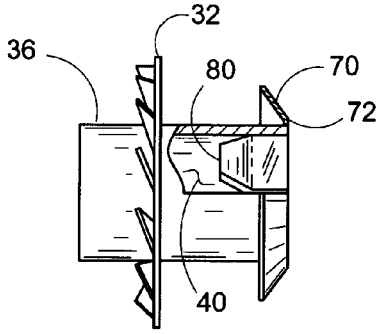

FIG. 4 and FIG. 5 show fluid device 30 and show a break away view of interior passage 40 and the secondary flow directing blades 80.

Figure 6:
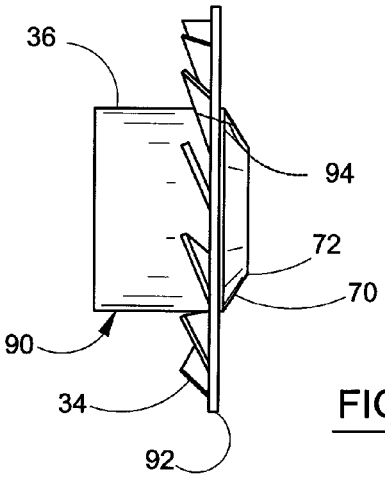
FIG. 6 diagrammatically illustrates an alternative embodiment of the fluid mixing device.

FIG. 6 shows a different design for the fluid mixing device. Fluid mixing device 90 includes an annular ring 92 with a plurality of radial blades 34. The blades are similar in nature to blades 34 in FIG. 3. However, the axial length of hub 36 is shorten such that the forward end 72 of hub 36 is adjacent ring 92 and has a frustoconical surface 70 which causes radially outward flow to the ring blades. The frustoconical surface 70 is adjacent or directly on annular ring 92. The stability of the fluid director may be enhanced by the close axial spacing of frustoconical surface 70 with annular ring 92. The interior design of the hub structure may be slotted or blade-carrying has shown in dashed lines 94. The alternate fluid director device 90 has an annular ring 92 that can be mounted in grooves 42, 33 of the housing. In this manner, the grooves 42, 33 may be moved to a forward position or rearward position in the housing as necessary. Also in this manner, the alternate fluid device 90 may provide greater stability with fluid flow from inlet side 13*a* to outlet side 13*b*. The forward most interior surface of hub 36 may be tapered or sloped radially outward (see dashed line 94) to better control fuel flow through director 90.

In general, fuel conditioner ionizer 10 is thermally coupled to the internal combustion engine or the burner in a furnace and acts as a catalyst for the fuel. The housing 12 is a cylindrical tube preferably composed of copper/nickel. The housing tube 10 contains a stainless steel "sponge" wire mesh or wire strand 46 and a copper "sponge" wire mesh or wire strand 48. Mesh 46, 48 are of dissimilar materials and the wire mesh, collectively, occupies 75% of the interior volume of the tube housing 12. At each end of the tube are a series of metal screens 20, 22.

In one embodiment, the fluid director 30 is at the input end of the tube housing 12. In another embodiment, the fluid director 30 is at or near the exit or outlet end of the tube housing 12 (not shown). The fluid director creates a fuel vortex by passing the fuel through a set of fixed turbine blades. In the downstream position, the vortex generator imparts controlled angular directional flow to the fuel and this vortex floa maintains ionization of the fuel molecules. In both the upstream and downstream systems, the fluid directing blades increase the ionization of the fuel.

Each end of the tube has a tapped and threaded end cap 14, 54. With respect to internal combustion engines, the fuel conditioner ionizer 10 is placed in-line, in the fuel line, at a point as close as possible to the combustion chamber of the engine, either in front of the injector pump or as close to the fuel rail input as possible.

The fuel conditioner ionizer 10 can be used on a wide range of gasoline and diesel engines. The use of the fuel conditioner ionizer 10 in connection with furnaces also achieves improved fuel utilization.

A discussion of the basic process of fuel ionization follows. When fuel flows over the dissimilar metals (meshes 46, 48 and Cu—Ni housing 12) inside the fuel conditioner ionizer 10, a small electrolytic charge is imparted to the fuel molecules. This molecular ionization effectively disrupts the normal structure of the molecule by creating more spacing in the molecular composition. The additional molecular spacing allows for greater contact with the oxygen component of the fuel thereby enhancing combustion. As this disrupted fuel reaches the injector, it is pressurized into a mist as it enters the combustion chamber. Normally the size of these droplets (mist) creates fuel molecular "clumping." It is believed that clumping is reduced by the downstream director version. However, because the fuel molecules are disrupted by ionization, the droplets are smaller and spaced out into a finer mist. The finer the mist, the more complete the combustion. The more complete the combustion, the more efficient the engine runs with less soot, smoke and noxious discharge.

Basic fuel ionization technology was used in the 1940s when the range of transcontinental bombers was extended with the fuel economy benefits of thermal coupling and ionization. NASA-JPL researchers Bellan and Hastad (see the reference in How It Works, DIY Fuel Ionizer article) have published a series of technical papers demonstrating that fuel ionization and thermal coupling is highly effective and superior to turbo charged infection alone.

By way of background, the energy efficiency of internal combustion engines (gasoline and diesel) and furnaces burning similar fuel continues to be an ongoing concern primarily because of the need to preserve our natural resources, eliminate foreign dependency on fossil fuels and protection of our environment. Thermodynamics has proven that internal combustion engines are somewhat inefficient. Current engine designs do not approach the theoretical limit of energy efficiency primarily because of the methods now used to mix oxygen and petroleum fuels necessary for combustion. Normally, fuel is introduced into an engine's combustion chamber using a spray technique, which leaves considerable aggregation of organic molecules resulting in restricted fuel-oxygen contact. This restricted mixing produces incomplete burning and the formation of unburned organic material referred to as soot. The quantity of soot formed during burning a spray is a function of air velocity, the size of drops in the spray, pressure, surrounding environmental composition, and the carbon to hydrogen ratio.

The method proposed in this invention, to reduce soot and to improve the efficiency of the engine or the furnace burner, alters the propensity of the fuel spray and increases dispersal of the molecular fuel into smaller drops to control soot formation. Two methods have been broadly investigated as potential solutions for producing smaller fuel drops. These methods are eddying and electrostatic dispersion. Electrostatic dispersion has been proven by tests conducted by NASA. The technique is accomplished by passing the fuel through an electric field inducing electrostatically charged molecules that repulse each other. The result is the formation of smaller drops, better mixing with oxygen and a more complete burn of fuel, thereby lessening soot formation.

The present invention shows that an electric current can be produced without the need for extensive wiring or power source. Since 1821 it has been known that a thermoelectric voltage may be induced by the touching of two dissimilar metals. This principle has long been used in thermocouple temperature measurements. The voltage from this combination of different metal changes as temperature changes. A device containing "touching dissimilar metals" placed near an internal combustion engine would heat up and a electric field would be induced.

When fuel is passed through this electric field, electrostatically charged fuel molecules are produced. The result is more efficient fuel combustion.

The present invention, a fuel conditioner ionizer, reduces soot formation in an internal combustion engine and a furnace burner by providing for a cleaner and more complete burning of fuel. The result is a more energy efficient engine. The fuel conditioner ionizer is designed for both gasoline and diesel engines.

It is believed that the molecular reaction occurs as the fuel flows in direct contact with, collides with, passes over, and oscillates through a combination of precious and nonprecious metals and metal alloy knitting or mesh wire spiral coils 46, 48 and screens 20, 22. The screens may be made of aluminum or other metal discussed later. The screen are placed in the inlet and outlet passageways of the cylindrical copper and nickel housing device 12. The copper and nickel housing 12 is so described because its principal alloy components are those metals, but the actual metallurgical constituency is specifically set forth hereinafter. The knitted mesh spiral coiled wire stands 46, 48 are compacted and composed of various metals, base metals and metal alloys as more specifically set forth hereinafter.

To enhance ionization, the fuel director may be magnetized.

The fuel begins conditioning as the fuel is dispersed throughout apparatus 10 by fuel director unit 30. The fuel conditioning utilizes, in one embodiment, a stainless steel screen mesh 46 encased and disposed within a copper and nickel housing 12, which may be encased by another metal protective outer housing (not shown). The copper and nickel housing 12 may have the following ranges of metallurgical constituents: C-0.001% to 0.007%, Cu-87.12% to 87.51%, Fe-1.33% to 1.39%, Mn-0.51% to 0.58%, Ni-10.38% to 10.82%, P-0.001%, Pb-0.007%, S-0.010 to 0.011%, and Zn-0.076% to 0.12%. The mechanical properties of housing 12 may be EG/% 31 to 32, GS/MM 0.035 to 0.025, TS/KSI 51.1 TO 51.8, YS/KSI 21.3 TO 22.5.

Stainless steel wire mesh screen 46 is fitted with a combination of multidirectional metal alloy spiral coiled wire strands 48. Strands 46, 48 are compressed and bunched into a resonant/vibrating electrostatic energy and heat transfer element housing 12. As fuel enters inlet port fitting 14, it immediately comes into contact with screen mesh 20. In the upstream system, the fuel flow director further mixes the fuel in and about mesh 46, 48. In the downstream system, the ionized fuel is swirled, in a controlled flow directed manner, which vortex flow maintains the ionization charge as the fuel moves to the engine or burner. Fuel conditioner ionizer apparatus 10 is mounted near the vehicle engine and also absorbs engine heat. The fuel is thermally activated by the heat of housing 12, which further excites and accelerates the breakup of the hydrocarbon fuel molecules flowing through the cylindrical apparatus as noted by arrows 13*a*, 13*b*. As the fuel flows past the screen mesh 46, it comes into contact with a variety of different metallic alloy strands 48 and against the internal wall surfaces 12 of the copper-nickel housing. Directors 30, 90 cause spiral or vortex like fuel flow.

A catalytic reaction occurs as the fuel collides against and through the spiral shaped metal strands 46, 48 and against copper-nickel housing 12. The conditioned fuel is dispersed through outlet port fitting 54 to the inlet of the engine fuel pump or the furnace burner.

The end caps 14, 54 housing 12 are threaded internally. End caps 14, 54 may be made of stainless steel or anodized aluminum. Any type of sealing system, a thread, or a clamp-on or other tight fitting can be used to attach housing 12 to the fuel line for the engine or the furnace burner.

Combinations of materials and configurations show an improved hydrocarbon fuel combustion efficiency. In a preferred embodiment, the present invention is used in fuel delivery systems of internal combustion diesel and gasoline engines and burners for furnaces. The method and apparatus 10 uses three primary components, the first being a hollow, elongated, cylindrical, preferably 90% copper and 10% nickel metal pipe housing 12 with stainless steel or anodized aluminum inlet and outlet metal end caps 14, 54. The second set of components, located inside housing 12, is (i) a bundle of stainless steel knitted mesh coiled wire stands 46, which is a combination of multidirectionally spiraled coiled, metal alloy wires and (ii) another set of wire strands 48 with different metallurgic composition. Third, fuel is mixed or directed by the fixed turbine blades of director 30. These are semi-loosely compressed and bunched into a resonant vibrating electrostatic energy and heat transfer elements, with silver and aluminum wire screen mesh 20, 22 at the inlet and outlet port fittings 14, 54 within the stainless steel or anodized aluminum housing end caps 14, 54. The knitted mesh coiled wire stands 48 may an actual metallurgical composition which includes various precious metals base metals and metal alloys including Ni, Cr, Mn, Si, C, P, S, Ag, and Fe. Cu—Ni may also be used for mesh 48. In the preferred embodiment, the second wire mesh 48 is a different metallurgic composition than stainless steel knitted mesh coiled wire stands 46, such as Cu—Ni.

The fluid director is a stationary turbine blade system with swirls the fuel over the wire mesh 46, 48 thereby enhancing ionization and thermal energy transfer from the hotter housing 12 to the cooler fuel flowing from input 13*a* to output 13*b*. In the downstream version, the charged fuel molecules remain charges due to the vortex created in the fuel by the flow director.

Alternatively, fluid director 30 may be made of a different alloy, other than stainless steel wire mesh 46, to achieve the ionization effect as disclosed herein. In this situation, only a single wire mesh 46 (stainless) is used in the Cu—Ni housing 12, with a fluid director unit 30 made of various precious metals base metals and metal alloys including Ni, Cr, Mn, Si, C, P, S, Ag, and Fe. Cu—Ni may also be used for fluid director unit 30. The claims appended hereto are meant to cover such an embodiment.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The claims appended hereto are meant to cover modifications and changes within the scope and spirit of the present invention.

What is claimed is:

1. An apparatus for treating fuel for increasing fuel combustion efficiency in an internal combustion engine or a furnace supplied with fuel via a fuel line, the fuel line having a fuel line supply segment carrying fuel and a fuel receiving segment in fluid communication with said internal combustion engine or said furnace, comprising:

a fuel containment housing having an inlet port and an outlet port;

means for sealingly connecting said housing inlet port to said fuel line supply segment;

means for sealingly connecting said housing outlet port to said fuel line receiving segment;

a plurality of metal wire strands formed of a plurality of different metals contained within said housing; and a fluid mixing device mounted in said fuel containment housing, said fluid mixing device including a plurality of radially extending blades circumferentially disposed at intervals within said fuel containment housing to impart angular flow to said fuel;

wherein said fluid mixing device includes a central cylindrical hollow hub and an annular ring about said central hub, said annular ring retaining said radially extending blades, and said hub having a second plurality of radially extending blades circumferentially disposed in said hub at intervals to impart additional angular flow to said fuel.

2. An apparatus for treating fuel as claimed in claim 1 wherein said blades impart angular flow of said fuel over said plurality of metal wire strands of different metals.

3. An apparatus for treating fuel as claimed in claim 1 wherein said fluid mixing device is magnetic and is interposed in said housing intermediate said inlet port and said plurality of metal wire strands of different metals.

4. An apparatus for treating fuel as claimed in claim 1 wherein said annular ring mounted in said housing.

5. An apparatus for treating fuel as claimed in claim 1 wherein said central hub and annular ring mounted in said housing.

6. An apparatus for treating fuel as claimed in claim 1 wherein said radially extending blades mounted in said housing.

7. An apparatus for treating fuel as claimed in claim 1 wherein said fluid mixing device is mounted in said housing by said hub.

8. An apparatus for treating fuel as claimed in claim 1 wherein said fluid mixing device is mounted in said housing by said annular ring.

9. An apparatus for treating fuel as claimed in claim 1 wherein said fluid mixing device is mounted in said housing by said hub and said annular ring.

10. An apparatus for treating fuel as claimed in claim 9 including at least one screen disposed in said housing near said inlet port and wherein said hub protrudes forward adjacent said at least one screen as a stabilizing mount in said housing.

11. An apparatus for treating fuel as claimed in claim 1 wherein said annular ring has a central frustoconical element for directing fuel radially towards said blades.

12. An apparatus for treating fuel as claimed in claim 11 wherein said central frustoconical element has a central through passage for central fuel flow.

13. An apparatus for treating fuel as claimed in claim 1 wherein said central cylindrical hollow hub has a central frustoconical element forward of said annular ring for directing fuel radially towards said blades.

14. An apparatus for treating fuel as claimed in claim 1 wherein said fluid mixing device is magnetic and is interposed in said housing intermediate said outlet port and said plurality of metal wire strands of different metals.

15. An apparatus for treating fuel as claimed in claim 14 wherein said fluid mixing device includes an annular ring retaining said radially extending blades, said annular ring mounted in said housing.

16. An apparatus for treating fuel as claimed in claim 15 wherein said fluid mixing device includes a central hub and said annular ring is disposed about said central hub, said hub mounted in said housing.

17. An apparatus for treating fuel as claimed in claim 16 wherein said annular ring mounted on said housing.

18. An apparatus for treating fuel as claimed in claim 17 wherein said hub is a central cylindrical hollow hub, said hub having a second plurality of radially extending blades circumferentially disposed in said hub at intervals to impart additional angular flow to said fuel.

19. An apparatus for treating fuel as claimed in claim 18 wherein said fluid mixing device is mounted in said housing by said hub.

20. An apparatus for treating fuel as claimed in claim 18 wherein said fluid mixing device is mounted in said housing by said annular ring.

21. An apparatus for treating fuel as claimed in claim 18 wherein said fluid mixing device is mounted in said housing by said hub and said annular ring.

22. An apparatus for treating fuel as claimed in claim 19 including at least one screen disposed in said housing near said inlet port and wherein said hub protrudes forward adjacent said at least one screen as a stabilizing mount in said housing.

23. An apparatus for treating fuel as claimed in claim 18 wherein said annular ring has a central frustoconical element for directing fuel radially towards said blades.

24. An apparatus for treating fuel as claimed in claim 23 wherein said central cylindrical hollow hub has a central frustoconical element forward of said annular ring for directing fuel radially towards said blades.

25. An apparatus for treating fuel for increasing fuel combustion efficiency in an internal combustion engine or a furnace supplied with fuel via a fuel line, the fuel line having a fuel line supply segment carrying fuel and a fuel receiving segment in fluid communication with said internal combustion engine or said furnace, comprising:

a fuel containment housing having an inlet port and an outlet port;

means for sealingly connecting said housing inlet port to said fuel line supply segment;

means for sealingly connecting said housing outlet port to said fuel line receiving segment;

a plurality of metal wire strands next to a fluid mixing device mounted in said fuel containment housing, said wire strands and fluid mixing device formed of a plurality of different metals; and said fluid mixing device including a first plurality of radially extending blades circumferentially disposed at intervals within said fuel containment housing to impart angular flow to said fuel;

said fluid mixing device includes an annular ring retaining said first radially extending blades which extend from said annular ring to a central hub, said annular ring is disposed radially beyond said central hub, said hub having a second plurality of radially extending blades circumferentially disposed in said hub at intervals to impart additional angular flow to said fuel.

26. An apparatus for treating fuel as claimed in claim 25 wherein said annular ring mounted in said housing.

27. An apparatus for treating fuel as claimed in claim 26 wherein said hub mounted in said housing.

28. An apparatus for treating fuel as claimed in claim 27 wherein said hub is a central cylindrical hollow hub with said second plurality of radially extending blades circumferentially disposed in a central region of said cylindrical hub at intervals to impart additional angular flow to said fuel.

29. An apparatus for treating fuel as claimed in claim 28 wherein said fluid mixing device is mounted in said housing by said hub.

30. An apparatus for treating fuel as claimed in claim 29 wherein said fluid mixing device is mounted in said housing by said annular ring.

31. An apparatus for treating fuel as claimed in claim 30 wherein said fluid mixing device is mounted in said housing by said hub and said annular ring.

32. An apparatus for treating fuel as claimed in claim 31 including at least one screen disposed in said housing near said inlet port and wherein said hub protrudes forward adjacent said at least one screen as a stabilizing mount in said housing.

33. An apparatus for treating fuel as claimed in claim 32 wherein said annular ring has a central frustoconical element for directing fuel radially towards said blades.

34. An apparatus for treating fuel as claimed in claim 33 wherein said central cylindrical hollow hub has a central frustoconical element forward of said annular ring for directing fuel radially towards said blades.

* * * * *